US010882174B2

(12) United States Patent
Chartier

(10) Patent No.: US 10,882,174 B2
(45) Date of Patent: Jan. 5, 2021

(54) VERSATILE SLIDE HAMMER METHOD AND APPARATUS

(71) Applicant: Gary Claude Chartier, Toronto (CA)

(72) Inventor: Gary Claude Chartier, Toronto (CA)

( * ) Notice: Subject to any disclaimer, the term of this patent is extended or adjusted under 35 U.S.C. 154(b) by 106 days.

(21) Appl. No.: 16/210,673

(22) Filed: Dec. 5, 2018

(65) Prior Publication Data

US 2019/0193254 A1 Jun. 27, 2019

(30) Foreign Application Priority Data

Dec. 27, 2017 (CA) ..... 2990144

(51) Int. Cl.
*B25D 1/16* (2006.01)
*B21D 1/06* (2006.01)

(52) U.S. Cl.
CPC ..... *B25D 1/16* (2013.01); *B21D 1/065* (2013.01); *B25D 2250/105* (2013.01); *B25D 2250/171* (2013.01); *B25D 2250/295* (2013.01)

(58) Field of Classification Search
None
See application file for complete search history.

(56) References Cited

U.S. PATENT DOCUMENTS 5,042,591 A * 8/1991 Hull ..... B25D 1/16 173/132
6,109,365 A * 8/2000 Lamoureux ..... A01B 1/02 173/128
8,695,458 B2 * 4/2014 Jensen ..... B25D 1/16 157/1.3
9,908,161 B1 * 3/2018 Gamble ..... B21D 1/06
10,421,180 B2 * 9/2019 Rix ..... B25D 1/16
2005/0278867 A1 * 12/2005 Hansen ..... B25D 1/16 7/143
2012/0103644 A1 * 5/2012 Walsh ..... A01B 1/026 173/118
2012/0228568 A1 * 9/2012 Leon ..... B25C 11/00 254/21
2016/0221132 A1 * 8/2016 Wong ..... B25B 7/12

* cited by examiner

*Primary Examiner* — Sunit Pandya

(57) ABSTRACT

The present invention provides a means to achieve enhanced control of repair forces in the automotive body repair industry. In particular, the present invention provides a modified slide hammer and a method to achieve repair through the controlled application of forces otherwise not attainable with existing embodiments. Additionally, the present invention provides an ease of use and versatility of application and mounting at the site of the work in conjunction with and in line with existing devices used in the repair process. The application of the present invention provides increased reliability in the delivery of intended forces at the site of the work. Further, the inherent isolation of repair forces to the intended site of the work by the use of the present invention reduces the likelihood of secondary damage, material waste, or catastrophic failure thereby also enhancing the safety of the operator and the effectivity of repair. Specifically, the present invention may be implemented in conjunction with existing frame pullers in the automotive body repair industry to affect repair while providing facility to avoid obstructions in the path of applied forces.

10 Claims, 7 Drawing Sheets

VERSATILE SLIDE HAMMER METHOD AND APPARATUS

BACKGROUND OF THE INVENTION

1. Field of the Invention

The present invention generally relates to slide hammers used to provide impact forces normal to the plane of the site of the work. Specifically, the present invention relates to methods and apparatus employed to deliver impact forces for the purposes of repair. The application of the present invention for the delivery of impact forces is appropriate where a static force is present and impact forces are required along the same vector. This invention finds particular application in the repair of collision related distortions of surfaces and structural elements in the automotive body repair industry wherein greater control of applied corrective forces is desirable.

2. Description of the Prior Art

Prior art embodiments of slide hammer apparatus are used to provide impact forces by direct connection of the ends of the hammer to the work on one side and the pulling force on the other. Such devices are generally used to provide controlled impact forces to correct collision related surface and structural distortions in the automotive repair industry. These slide hammers are typically mounted at the site of the work using hooks, screw threads, jaws, and clamps among other methods. Due to the limitations of the mounting methods, the setup time may be considerable while in some instances unsafe for the operator. Additionally, the operator is often unable to readily negotiate obstacles in the path of the intended impact forces without reconfiguring the work environment. The setup times combined with the lack of facility for the avoidance of obstacles reduce the overall efficiency and quality of the repair provided by prior art embodiments. Further, the operator is often forced to neglect best practices in the pursuit of expediency during the setup phase of existing apparatus and methods and may thereby imperil their safety.

SUMMARY OF THE INVENTION

The present invention allows the operator to mount a slide hammer apparatus in line with an existing static pull force in order to perform the repair of automotive components distorted by collision damage or otherwise. In particular, the operator is able to use existing equipment, such as a frame puller, generally available in the shop of the automotive body technician in conjunction with the present invention to enhance the ability to control forces used in the action of repair. Thereby, the operator is able to achieve a level of control of the corrective forces otherwise not attainable with the use of a frame puller or conventional slide hammer alone. By permitting said greater control over the corrective forces delivered at the site of the work, the operator is able to increase the effectivity and safety of the repair process. The safety of the repair process is enhanced by the ability of the operator to reduce the static force requirements with the use of the present invention. The versatility of the present invention allows the operator to mount the versatile slide hammer at any point along the line of the static pull force thereby facilitating the avoidance of obstructions in the pull path. Additionally, the operator does not have to remove the versatile hammer from the pull chain of the frame puller between operations. The application of the present invention increases the efficiency and quality of repair undertaken therewith while enhancing the safety of the operator thereby providing a method and apparatus generally free of the deficiencies of the prior art.

DETAILED DESCRIPTION OF THE PREFERRED EMBODIMENT

Figure 1:
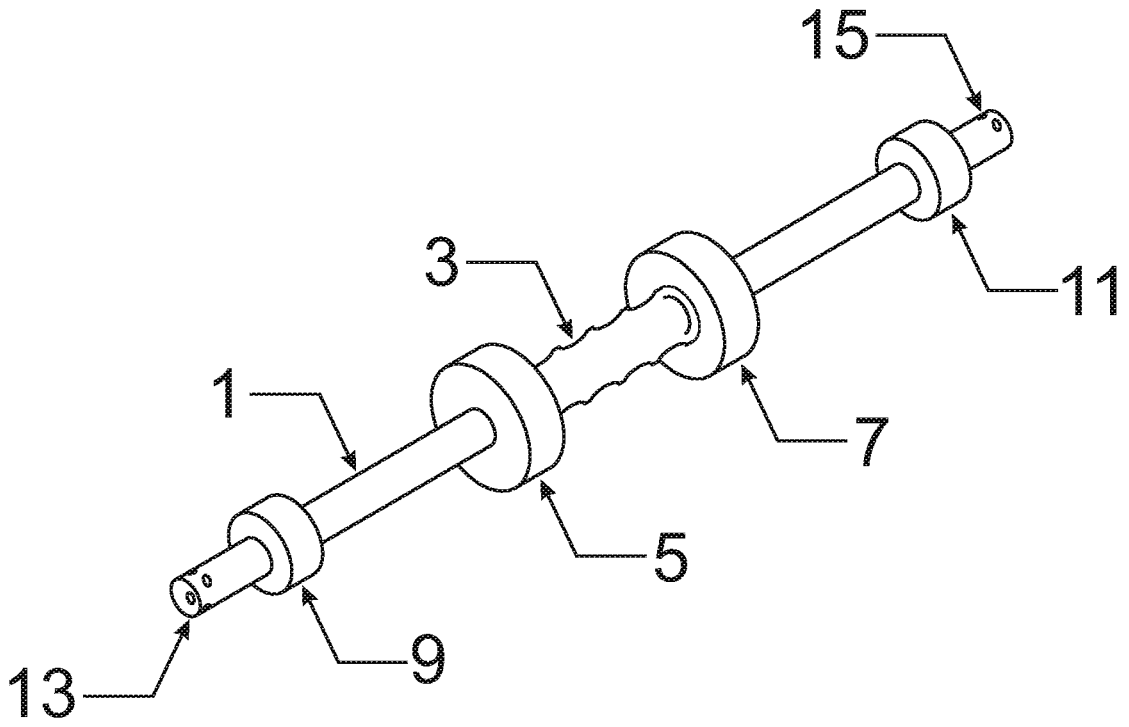
FIG. 1 is an isometric view of an embodiment of a versatile slide hammer apparatus.

In order to better understand the embodiment of the present invention, an embodiment of the versatile slide hammer apparatus will be described with reference to FIGS. 1 through 5. An embodiment of a versatile slide hammer apparatus is provided as in FIG. 1 comprised of an hollow shaft element 1, a sliding hammer element with gripping surface 3 and first and second strike elements 5 and 7, a first stop element 9, a second stop element 11, first hollow shaft end 13, and second hollow shaft end 15. Operation of said versatile slide hammer apparatus is facilitated by the free movement of said sliding hammer element along the hollow shaft 1 between stop elements 9 and 11. Stop elements 9 and 11 are rigidly fixed to hollow shaft 1. Striking stop element 9 with strike element 5 transfers that strike force to the hollow shaft 1 along a vector passing from strike element 5 to stop element 9. Conversely, striking stop element 11 with strike element 7 transfers that strike force to the hollow shaft 1 along a vector passing from strike element 7 to stop element 11.

Figure 2:
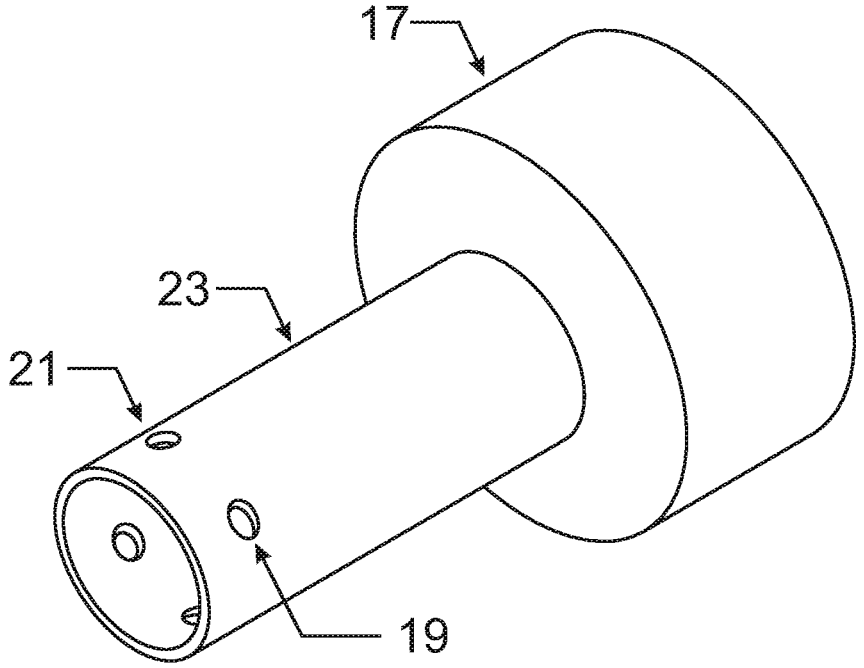
FIG. 2 is an isometric view of one end of an embodiment of a versatile slide hammer apparatus.

To provide greater understanding of the construction of the versatile slide hammer apparatus, one end of an embodiment of a versatile slide hammer apparatus is provided as in FIG. 2. A stop element 17 is rigidly fixed to hollow shaft 23 as above. Holes, such as holes 19 and 21, are provided to facilitate the implementation of a locking mechanism as discussed below. It is understood that the configuration, location, and number of said holes is variable based on application, construction limitations, and other requirements and that variation of such does not constitute a departure from the spirit of the present invention.

Figure 3:
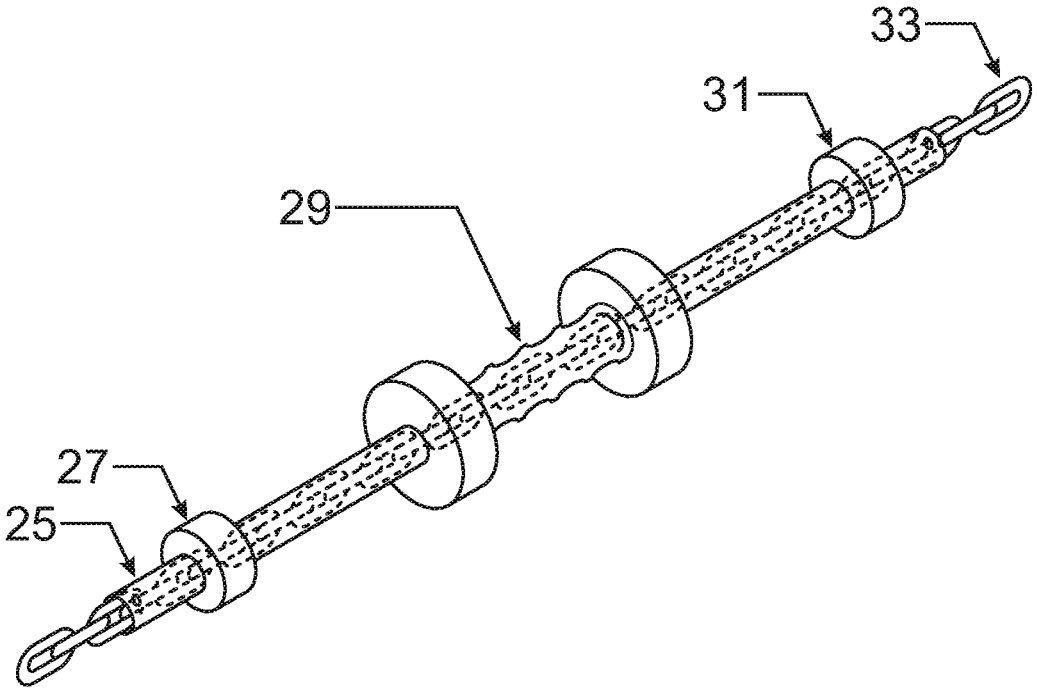
FIG. 3 is an isometric view of an embodiment of a versatile slide hammer apparatus with a chain passing through it lengthwise.

An embodiment of the versatile slide hammer apparatus is provided as in FIG. 3. The versatile slide hammer apparatus is provided with an hollow shaft 25, a first stop element 27, a sliding hammer element 29, and a second stop element 31 as previously described in FIG. 1. Said hollow shaft 25 is of sufficient inner diameter to permit the passing of a chain 33 through the full length of said hollow shaft 25.

Figure 4:
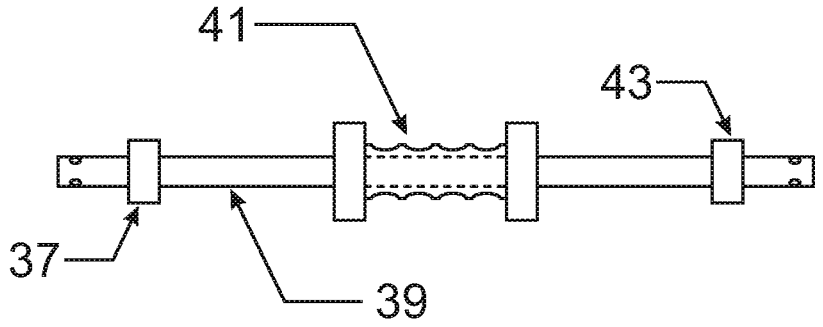
FIG. 4 is a side view of an embodiment of a versatile slide hammer apparatus.

An embodiment of the versatile slide hammer apparatus is provided as in FIG. 4. The versatile slide hammer apparatus is provided with an hollow shaft 39, a first stop element 37, a sliding hammer element 41, and a second stop element 43 as previously described in FIGS. 1 and 3. Slide hammer element 41 is shown to be of sufficient inner diameter to permit the free movement of said slide hammer element 41 along the length axis of hollow shaft 39 between said first and second stop elements 37 and 43 respectively.

Figure 5:
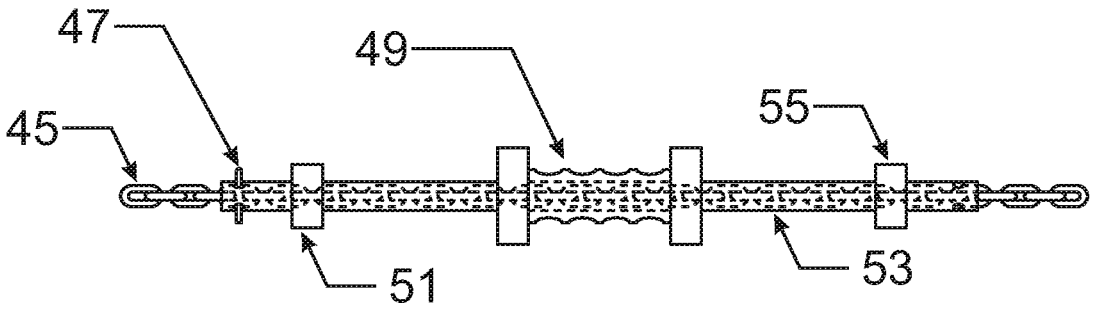
FIG. 5 is a side view of an embodiment of a versatile slide hammer apparatus locked into position on a chain passing through it lengthwise.

An embodiment of the versatile slide hammer apparatus is provided as in FIG. 5. Said versatile slide hammer apparatus is provided with an hollow shaft 53, a first stop element 51, a sliding hammer element 49, and a second stop element 55 as previously described in FIGS. 1, 3, and 4. A chain 45 is shown to be passing through hollow shaft 53. A locking element 47 is shown to be engaged with said hollow shaft 53 and said chain 45 in order to prevent movement of the versatile hammer apparatus relative to said chain 45. Operation of said slide hammer element 49 along the axis of said hollow shaft 53 will thus transfer forces delivered to stop elements 51 and 55 to said chain 45.

Figure 6:
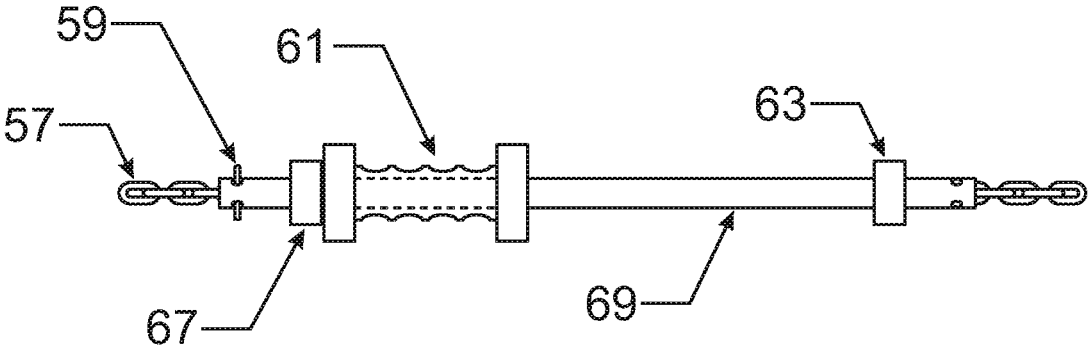
FIG. 6 is a side view of the operation of a versatile slide hammer apparatus with the handle positioned at the locked end.

The operation of an embodiment of the versatile slide hammer apparatus is provided as in FIG. 6. Said versatile slide hammer apparatus is provided with an hollow shaft 69, a first stop element 67, a sliding hammer element 61, and a second stop element 63 as previously described in FIGS. 1, 3, 4 and 5. A chain 57 is shown to be passing through hollow shaft 69. A locking element 59 is shown to be engaged with said hollow shaft 69 and said chain 57 as previously described in FIG. 5. The sliding hammer element 61 is permitted free movement along the axis of the hollow shaft 69 between first and second stop elements 67 and 63 respectively and is shown to be striking said first stop element 67 in order to transfer said striking forces to said chain 57.

Figure 7:
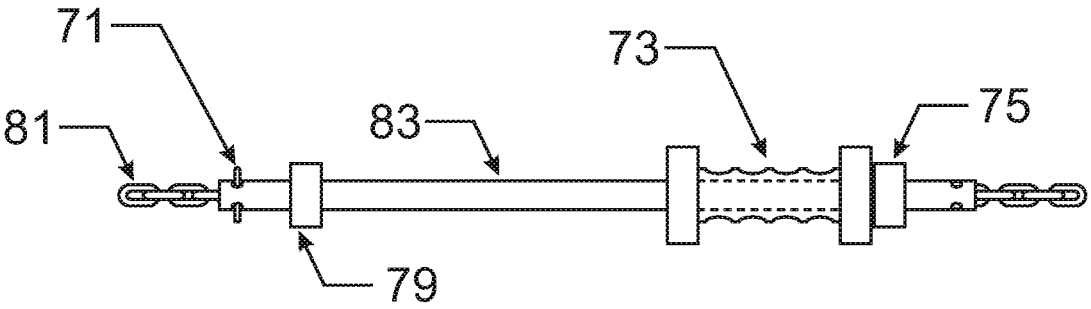
FIG. 7 is a side view of the operation of a versatile slide hammer apparatus with the handle positioned at the unlocked end.

Further operation of an embodiment of the versatile slide hammer apparatus is provided as in FIG. 7. Said versatile slide hammer apparatus is provided with an hollow shaft 83, a first stop element 79, a sliding hammer element 73, and a second stop element 75 as previously described in FIGS. 1, 3, 4, 5 and 6. A chain 81 is shown to be passing through hollow shaft 83. A locking element 71 is shown to be engaged with said hollow shaft 83 and said chain 81 as previously described in FIGS. 5 and 6. The sliding hammer element 73 is permitted free movement along the axis of the hollow shaft 83 between first and second stop elements 79 and 75 respectively and is shown to be striking said second stop element 75 in order to transfer said striking forces to said chain 81.

Figure 8:
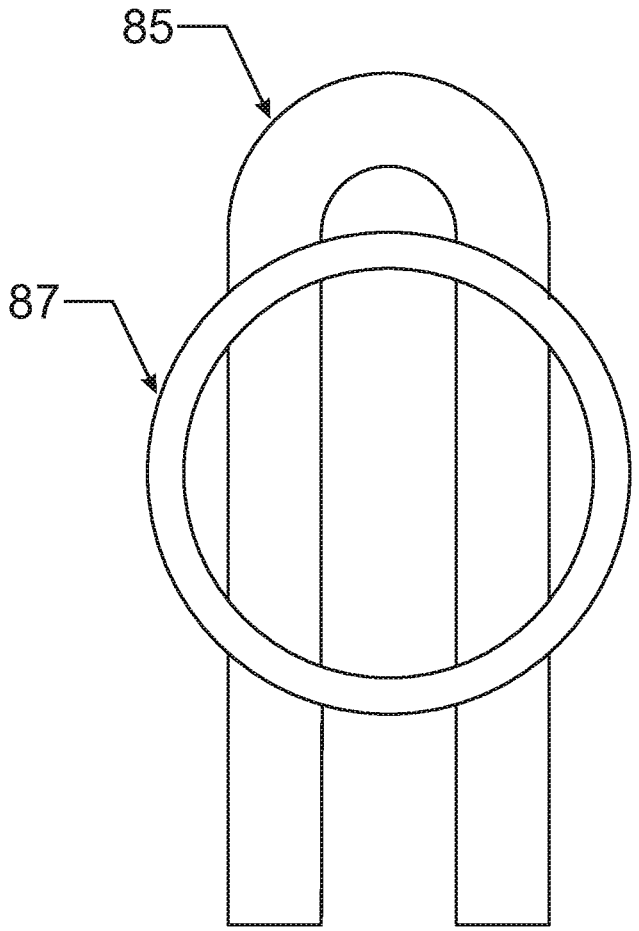
FIG. 8 is a view along the length axis of an embodiment of a versatile slide hammer apparatus with an example of a lock engaged with the apparatus.

An embodiment of a locking mechanism for the versatile slide hammer apparatus is provided as in FIG. 8. An illustration of one end of the hollow shaft 87, as previously described in FIGS. 1 through 7, is provided with a view along its length axis. A locking element 85 is shown to be engaged with said hollow shaft 87. This embodiment of the locking element 85 is shown to be engaged with said hollow shaft 87 at four points. It is understood that locking element geometric configurations and engagement points thereof are variable based on the application, construction limitations, and other requirements and that variation of such does not constitute a departure from the spirit of the present invention.

Figure 9:
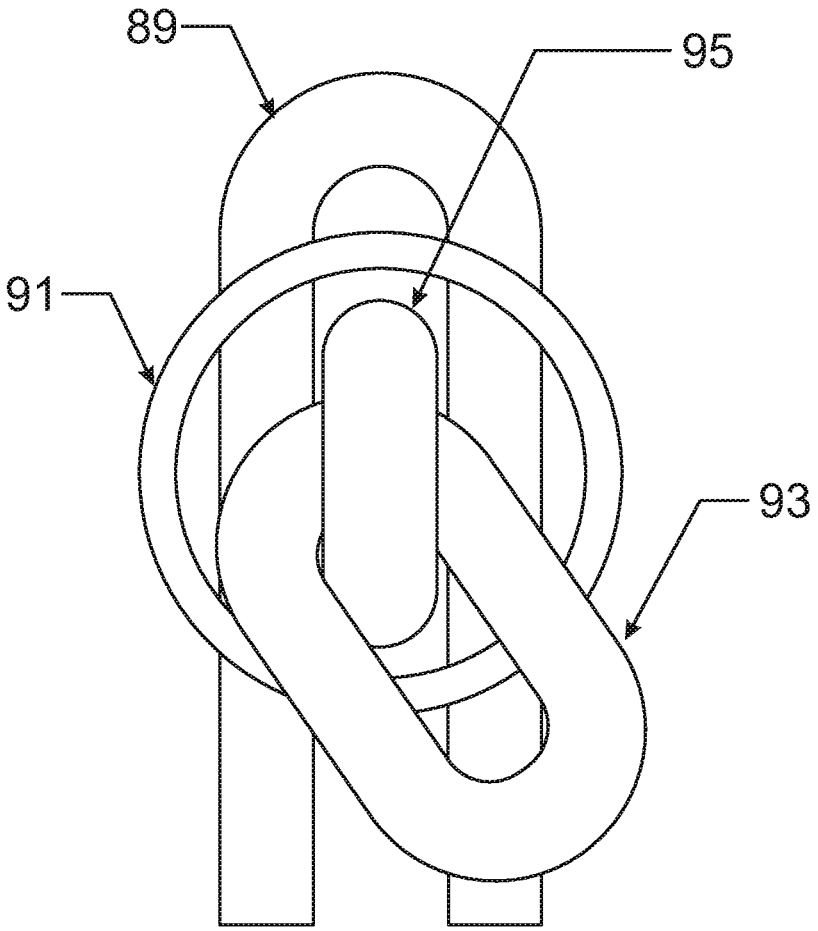
FIG. 9 is a view along the length axis of an embodiment of a versatile slide hammer apparatus with an example of a lock engaged with the apparatus and a chain.

An embodiment of a locking mechanism for the versatile slide hammer apparatus is provided as in FIG. 9. An illustration of one end of the hollow shaft 91, as previously described in FIGS. 1 through 8, is provided with a view along its length axis. A locking element 89 is shown to be engaged with said hollow shaft 91 and a chain 93. This embodiment of the locking element 89 is shown to be engaged with said hollow shaft 91 at four points and with said chain 93. A vertical chain link element 95 is shown to be passing through the center of said locking element 89 whereas a non-vertical chain link element could not. Thereby, movement of said chain 93 relative to said hollow shaft 91 is prevented along the length axis of said hollow shaft 91. It is understood that locking element geometric configurations and engagement points thereof with a chain or shaft are variable based on the application, construction limitations, and other requirements and that variation of such does not constitute a departure from the spirit of the present invention.

I claim as my invention:

1. A versatile slide hammer apparatus comprising: (a) a hollow shaft, provided with a hole or holes through its body with sufficient inner diameter to permit the passing of a chain, of a gauge and construction required by the work, through its full length; (b) a first stop element rigidly fixed near the first end of said hollow shaft; (c) a second stop element rigidly fixed near the second end of said hollow shaft; (d) a slide hammer element with free movement of its body along said hollow shaft between said first and second stop elements; (e) a locking mechanism, facilitate locking to said chain passing through its length.

2. A versatile slide hammer apparatus as in claim 1, wherein said slide hammer element is of a geometry to allow ease of grip by the operator and free movement of its body along said hollow shaft between said first and second stop elements.

3. A versatile slide hammer apparatus as in claim 2, wherein said slide hammer element has strike elements to engage said first and second stop elements.

4. A versatile slide hammer apparatus as in claim 3, wherein said slide hammer element is of sufficient mass and construction to deliver, under operation, intended forces to the body of the apparatus as required by the work.

5. A versatile slide hammer apparatus as in claim 1, wherein said locking mechanism facilitates the locking of the apparatus to a chain passing through its length.

6. A versatile slide hammer apparatus as in claim 1, wherein said locking mechanism may be located at one or more points along the length of said hollow shaft.

7. A versatile slide hammer locking mechanism as in claim 1, comprising: (a) the locking element; (b) the shaft engagement element.

8. A versatile slide hammer locking mechanism as in claim 7, wherein said locking element is of a geometry permitting free engagement of the hollow shaft of a versatile slide hammer apparatus and a chain passing there through.

9. A versatile slide hammer locking mechanism as in claim 7, where said shaft engagement element may comprise a hole or holes for the engagement of said locking element.

10. A versatile slide hammer locking mechanism as in claim 7, wherein the engagement of said locking element with the hollow shaft of a versatile slide hammer apparatus and a chain passing there through prevents the movement of said versatile slide hammer apparatus along the axis of said chain.

* * * * *